US010871176B2

(12) United States Patent
Matsuzaki et al.

(10) Patent No.: US 10,871,176 B2
(45) Date of Patent: Dec. 22, 2020

(54) FLUID PRESSURE CONTROL DEVICE

(71) Applicant: KYB Corporation, Tokyo (JP)

(72) Inventors: Keiichi Matsuzaki, Nagano (JP); Shunsuke Fukuda, Nagano (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 16/633,332

(22) PCT Filed: Feb. 27, 2019

(86) PCT No.: PCT/JP2019/007657

§ 371 (c)(1),
(2) Date: Jan. 23, 2020

(87) PCT Pub. No.: WO2019/207951

PCT Pub. Date: Oct. 31, 2019

(65) Prior Publication Data

US 2020/0157771 A1 May 21, 2020

(30) Foreign Application Priority Data

Apr. 27, 2018 (JP) ..... 2018-087396

(51) Int. Cl.
*F15B 11/16* (2006.01)
*E02F 9/22* (2006.01)
*F15B 11/17* (2006.01)

(52) U.S. Cl.
CPC ..... *F15B 11/162* (2013.01); *E02F 9/2285* (2013.01); *E02F 9/2292* (2013.01); *F15B 11/17* (2013.01); *F15B 2211/20576* (2013.01); *F15B 2211/329* (2013.01);
(Continued)

(58) Field of Classification Search
CPC ... F15B 11/162; F15B 11/17; F15B 2211/781; E02F 9/2285; E02F 9/2292
See application file for complete search history.

(56) References Cited

U.S. PATENT DOCUMENTS 5,083,428 A * 1/1992 Kubomoto ..... F15B 11/17 60/421
6,557,277 B1 * 5/2003 Hibi ..... E02F 3/4135 37/187

(Continued)

FOREIGN PATENT DOCUMENTS

JP 2006-083696 A 3/2006

*Primary Examiner* — Michael Leslie
(74) *Attorney, Agent, or Firm* — Rabin & Berdo, P.C.

(57) ABSTRACT

A fluid pressure control device includes a first switching valve provided on a downstream of a first travel control valve in the first main passage and having an open position and a priority position, a second switching valve provided on a downstream of a second travel control valve in the second main passage and having an open position and a priority position, and a merging passage connecting a downstream of the first switching valve and a downstream of the second switching valve. In a state where first work control valves and second work control valves are not operated and the first travel control valve is operated, the first switching valve is at a priority position, and in a state where the first work control valves and the second work control valves are not operated and the second travel control valves is operated, the second switching valve is at a priority position.

7 Claims, 5 Drawing Sheets

(52) U.S. Cl.
CPC ..... *F15B 2211/6355* (2013.01); *F15B 2211/7142* (2013.01); *F15B 2211/781* (2013.01)

(56) References Cited

U.S. PATENT DOCUMENTS

| | | | | |
|---|---|---|---|---|
| 7,721,538 | B2 * | 5/2010 | Koo | E02F 9/2292 60/422 |
| 7,743,611 | B2 * | 6/2010 | Horii | E02F 9/2296 60/421 |
| 8,607,557 | B2 * | 12/2013 | Ikeda | E02F 9/2242 60/421 |
| 9,890,801 | B2 * | 2/2018 | Takahashi | E02F 9/2239 |
| 10,378,560 | B2 * | 8/2019 | Tanaka | F15B 11/10 |

* cited by examiner

FLUID PRESSURE CONTROL DEVICE

TECHNICAL FIELD

The present invention relates to a fluid pressure control device.

BACKGROUND ART

JP2006-83696A discloses a hydraulic device in which a channel switching valve is switched to an independent position in a traveling state where a travel control valve is operated, and pressure oil from first and second pump ports of a pump is supplied to the right and left travel control valves independently, respectively.

SUMMARY OF INVENTION

In the hydraulic device described in JP2006-83696A, when one of the right and left travel control valves is operated, the channel switching valve is switched to the independent position. Therefore, even in a state where only one of the right and left travel control valves is operated and only one of travel devices is driven, the channel switching valve is switched to the independent position. Thus, in this state, the pressure oil at the pump port supplied to the travel control valve not operated is not utilized effectively, workability is lowered as a result.

The present invention has an object to provide a fluid pressure control device with excellent workability.

According to one aspect of the present invention, a fluid pressure control device includes a first main passage to which a working fluid is supplied from a first pump port; a second main passage to which the working fluid is supplied from a second pump port; a plurality of first work control valves for work devices connected to the first main passage in parallel; a plurality of second work control valves for work devices connected to the second main passage in parallel; a first travel control valve for a travel device connected to the first main passage in parallel at an upstream of the first work control valves; a second travel control valve for a travel device connected to the second main passage in parallel at an upstream of the second work control valves; a first switching valve provided on a downstream of a connection portion with the first travel control valve in the first main passage and having an open position where the first main passage is opened and a first priority position where the working fluid from the first pump port is led to the first travel control valve with priority; a second switching valve provided on a downstream of a connection portion with the second travel control valve in the second main passage and having an open position where the second main passage is opened and a first priority position where the working fluid from the second pump port is led to the second travel control valve with priority; and a merging passage connecting a downstream of the first switching valve in the first main passage and a downstream of the second switching valve in the second main passage. In a state where the first work control valves and the second work control valves are not operated and the first travel control valve is operated, the first switching valve is at the first priority position, and in a state where the first work control valves and the second work control valves are not operated and the second travel control valves is operated, the second switching valve is at the first priority position.

DESCRIPTION OF EMBODIMENTS

Hereinafter, embodiments of the present invention will be described by referring to the attached drawings.

First Embodiment

Figure 1:
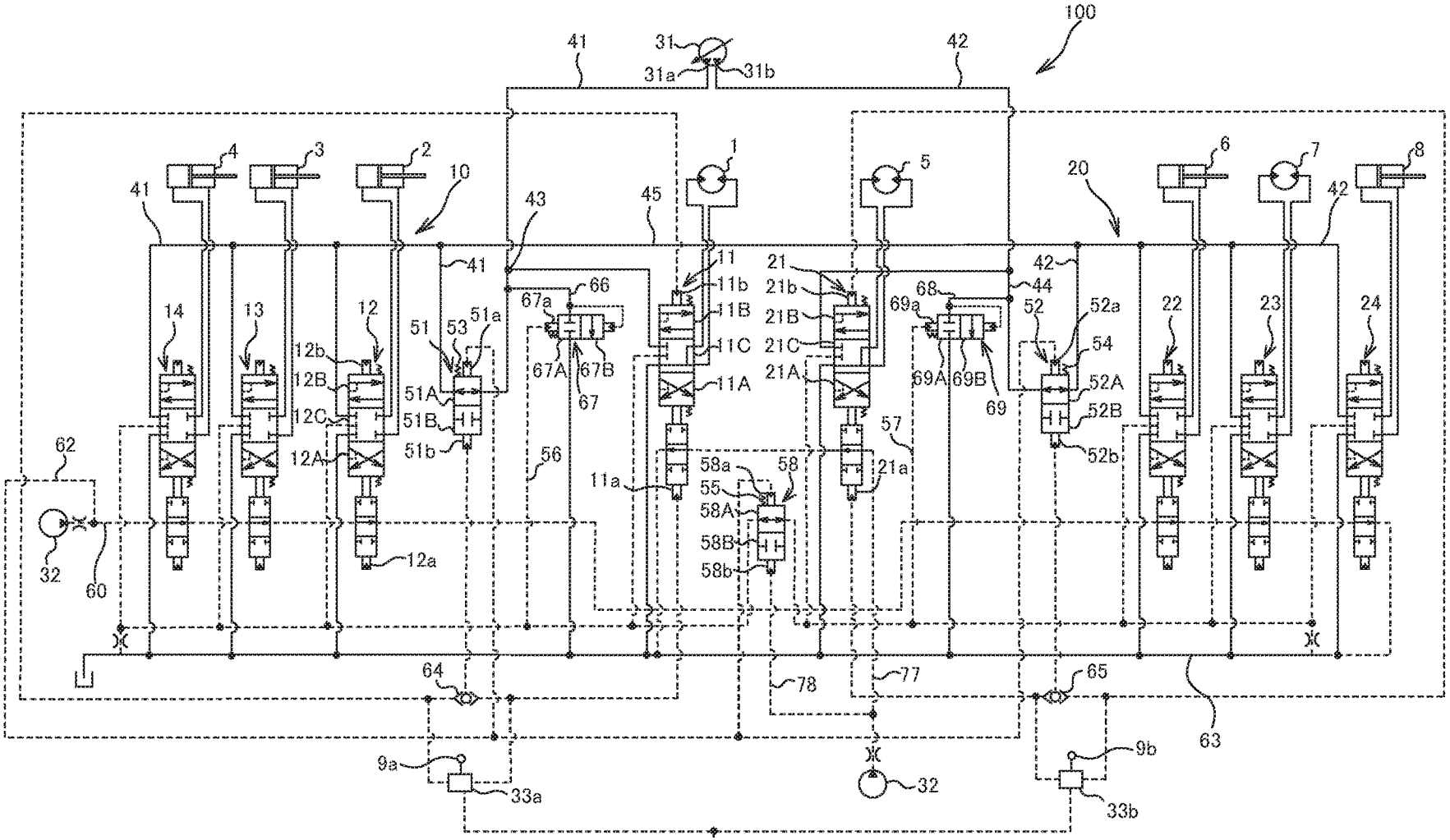
FIG. 1 is a circuit diagram of a fluid pressure control device according to a first embodiment of the present invention.

A fluid pressure control device 100 according to a first embodiment of the present invention will be described by referring to FIG. 1.

The fluid pressure control device 100 is for controlling an operation of a hydraulic work device such as a hydraulic excavator and the like. In this embodiment, a case in which an operation of the hydraulic excavator is controlled will be described.

The hydraulic excavator includes a plurality of actuators, that is, a left travel motor 1 for driving a left travel device, a boom cylinder 2 for driving a boom, a bucket cylinder 3 for driving a bucket, a blade cylinder 4 for driving a blade, a right travel motor 5 for driving a right travel device, an arm cylinder 6 for driving an arm, a turning motor 7 for turning driving, and a swing cylinder 8 for swing driving. Hereinafter, these motors and cylinders are also called hydraulic actuators.

The fluid pressure control device 100 includes an engine (not shown) as a power source, a main pump 31 as a fluid pressure supply source driven by the engine, and a pilot pump 32 as a pilot pressure supply source driven by the engine.

The main pump 31 is a hydraulic pump of a split-flow type having two pump ports, that is, a first pump port 31*a* and a second pump port 31*b*.

The fluid pressure control device 100 further includes a first main passage 41 to which a working oil (working fluid) is supplied from the first pump port 31*a*, a second main passage 42 to which the working oil is supplied from the second pump port 31*b*, a first circuit system 10 configured to control supply of the working oil from the first main passage 41 to hydraulic actuators 1 to 4, and a second circuit system 20 configured to control the supply of the working oil from the second main passage 42 to hydraulic actuators 5 to 8.

The first circuit system 10 has a first travel control valve 11 configured to control the supply of the working oil to the left travel motor 1, a boom control valve 12 configured to control the supply of the working oil to the boom cylinder 2, a bucket control valve 13 configured to control the supply of the working oil to the bucket cylinder 3, and a blade control valve 14 configured to control the supply of the working oil to the blade cylinder 4. The first travel control valve 11, the boom control valve 12, the bucket control valve 13, and the blade control valve 14 are connected to the first main passage 41 in parallel in this order. Hereinafter, the boom control valve 12, the bucket control valve 13, and the blade control valve 14 are also called first work control valves.

The second circuit system 20 has a second travel control valve 21 configured to control the supply of the working oil to the right travel motor 5, the arm control valve 22 configured to control the supply of the working oil to the arm cylinder 6, a turning control valve 23 configured to control the supply of the working oil to the turning motor 7, and a swing control valve 24 configured to control the supply of the working oil to the swing cylinder 8. The second travel control valve 21, the arm control valve 22, the turning control valve 23, and the swing control valve 24 are connected to the second main passage 42 in parallel in this order. Hereinafter, the arm control valve 22, the turning control valve 23, and the swing control valve 24 are also called second work control valves.

A position of the first travel control valve 11 is switched in accordance with a pilot pressure led to pilot chambers 11*a* and 11*b* from the pilot pump 32 through a pilot control valve 33*a* in accordance with the manual operation of an operation lever 9*a* by the operator of the hydraulic excavator. More specifically, when the pilot pressure is led to the pilot chamber 11*a*, the first travel control valve 11 is switched to an advance position 11A, and the left travel motor 1 is rotated forward and advances/drives the left travel device. When the pilot pressure is led to the pilot chamber 11*b*, the first travel control valve 11 is switched to a rearward position 11B, and the left travel motor 1 is rotated backward, and retreats/drives the left travel device. When the pilot pressure is not led to the pilot chamber 11*a* or 11*b*, the first travel control valve 11 is switched to a neutral position 11C, the left travel motor 1 is stopped, and the left travel device is stopped.

Similarly, as an operator of the hydraulic excavator manually operates the operation lever 9*b*, in accordance with the pilot pressure led to the pilot chambers 21*a* and 21*b* from the pilot pump 32 through a pilot control valve 33*b*, the position of the second travel control valve 21 (advance position 21A, backward position 21B, neutral position 21C) is switched.

A position of the boom control valve 12 is switched in accordance with the pilot pressure led to the pilot chambers 12*a* and 12*b* from the pilot pump 32 through the pilot control valve in accordance with the manual operation of the operation lever by the operator of the hydraulic excavator. More specifically, when the pilot pressure is led to the pilot chamber 12*a*, the boom control valve 12 is switched to a contraction position 12A, and the boom cylinder 2 is contracted/operated. When the pilot pressure is led to the pilot chamber 12*b*, the boom control valve 12 is switched to an extension position 12B, and the boom cylinder 2 is extended/operated. When the pilot pressure is not led to the pilot chamber 12*a* or 12*b*, the boom control valve 12 is switched to the neutral position 12C, and the extension/contraction operation of the boom cylinder 2 is stopped. Since the first work control valves 13 and 14 and the second work control valves 22 to 24 other than the boom control valve 12 have the configuration similar to that of the boom control valve 12, the description will be omitted. Hereinafter, in each of the control valves 11 to 14 and 21 to 24, positions, other than the neutral position, where the hydraulic actuator is actuated are also called operation positions.

In the first main passage 41, a first switching valve 51 is provided on the downstream of a connection portion 43 with the first travel control valve 11. Similarly, in the second main passage 42, a second switching valve 52 is provided on the downstream of a connection portion 44 with the second travel control valve 21. The downstream of the first switching valve 51 in the first main passage 41 and a downstream of the second switching valve 52 in the second main passage 42 are connected by a merging passage 45. In this way, the first main passage 41 and the second main passage 42 merge through the merging passage 45.

The first switching valve 51 has an open position 51A where the first main passage 41 is opened and a priority position 51B serving as a first priority position where the working oil from the first pump port 31*a* is led to the first travel control valve 11 with priority. The first switching valve 51 is switched to the open position 51A or the priority position 51B by a balance between the pilot pressure led to the pilot chambers 51*a* and 51*b* and a biasing force of a spring 53. At the open position 51A, the working oil supplied from the first pump port 31*a* to the first main passage 41 is supplied to the first travel control valve 11 and is also supplied to the first work control valves 12 to 14. At the same time, the working oil supplied from the first pump port 31*a* to the first main passage 41 is also supplied to the second main passages 42 through the merging passage 45. On the other hand, at the priority position 51B, since a flow of the working oil in the first main passage 41 is blocked, the working oil supplied to the first main passage 41 from the first pump port 31*a* is not supplied to the first work control valves 12 to 14 but supplied to the first travel control valve 11 with priority.

Similarly, the second switching valve 52 has an open position 52A where the second main passage 42 is opened and a priority position 52B serving as a first priority position where the working oil from the second pump port 31*b* led to the second travel control valve 21 with priority. The second switching valve 52 is switched to the open position 52A or the priority position 52B by a balance between the pilot pressure led to the pilot chambers 52*a* and 52*b* and the biasing force of a spring 54. At the open position 52A, the working oil supplied from the second pump port 31*b* to the second main passage 42 is supplied to the second travel control valve 21 and is also supplied to the second work control valves 22 to 24. At the same time, the working oil supplied from the second pump port 31*b* to the second main passage 42 is also supplied to the first main passage 41 through the merging passage 45. On the other hand, at the priority position 52B, since the flow of the working oil in the second main passage 42 is blocked, the working oil supplied to the second main passage 42 from the second pump port 31*b* is not supplied to the second work control valves 22 to 24 but supplied to the second travel control valve 21 with priority.

A first detection passage 60 configured to detect the operations of the first work control valves 12 to 14 and the second work control valves 22 to 24 is connected to the pilot pump 32. The first detection passage 60 is connected to a tank passage 63 via the blade control valve 14, the bucket control valve 13, the boom control valve 12, the arm control valve 22, the turning control valve 23, and the swing control valve 24 in order. A first detection pressure lead-out passage 62 branching from the upstream of the blade control valve 14 positioned at an uppermost stream is connected to the first detection passage 60. The first detection pressure lead-out passage 62 is connected to the pilot chamber 51*a* of the first switching valve 51 and the pilot chamber 52*a* of the second switching valve 52.

When all of the first work control valves 12 to 14 and the second work control valves 22 to 24 are not operated and are at the neutral position, since the first detection passage 60 communicates with the tank passage 63, the pilot pressure is not led to the pilot chamber 51*a* of the first switching valve 51 and the pilot chamber 52*a* of the second switching valve 52. On the other hand, in a state where at least one of the first work control valves 12 to 14 and the second work control valves 22 to 24 is operated, since the communication between the first detection passage 60 and the tank passage 63 is blocked, the pilot pressure is led to the pilot chamber 51*a* of the first switching valve 51 and the pilot chamber 52*a* of the second switching valve 52 through the first detection pressure lead-out passage 62.

The pilot chamber 51*b* of the first switching valve 51 is connected to the pilot chambers 11*a* and 11*b* of the first travel control valve 11 through a high-pressure selection valve 64. Therefore, the high pilot pressure of the pilot chamber 11*a* and the pilot chamber 11*b* is led to the pilot chamber 51*b* of the first switching valve 51. In this way, the pilot pressure for operation of the first travel control valve 11 is led to the pilot chamber 51*b* of the first switching valve 51 when the first travel control valve 11 is operated.

Similarly, the pilot chamber 52*b* of the second switching valve 52 is connected to the pilot chambers 21*a* and 21*b* of the second travel control valve 21 through the high-pressure selection valve 65, and the pilot pressure for operation of the second travel control valve 21 is led to the pilot chamber 52*b* when the second travel control valve 21 is operated.

A first unload passage 66 branching from the upstream of the first switching valve 51 is connected to the first main passage 41, and a first unload valve 67 is provided in the first unload passage 66. The first unload valve 67 has a block position 67A where the first unload passage 66 is blocked and an unload position 67B where a part of the working oil supplied from the first pump port 31*a* to the first main passage 41 is discharged to the tank passage 63. The first unload valve 67 is switched to the block position 67A when the pilot pressure is led to a pilot chamber 67*a*, and it is switched to the unload position 67B by the pressure on the upstream of the first unload valve 67 when the pilot pressure is not led to the pilot chamber 67*a*. A first pilot passage 56 is connected to the pilot chamber 67*a*, and each of the control valves 11 to 14 is connected to the first pilot passage 56. In a state where at least one of the control valves 11 to 14 is operated and at the operation position, the working oil discharged from the main pump 31 through the control valves 11 to 14 at the operation position is led to the first pilot passage 56.

Similarly, a second unload passage 68 branching from the upstream of the second switching valve 52 is connected to the second main passage 42, and a second unload valve 69 is provided in the second unload passage 68. The second unload valve 69 has a block position 69A where the second unload passage 68 is blocked and an unload position 69B where a part of the working oil supplied from the second pump port 31*b* to the second main passage 42 is discharged to the tank passage 63. The second unload valve 69 is switched to the block position 69A when the pilot pressure is led to a pilot chamber 69*a*, and it is switched to the unload position 69B by the pressure on the upstream of the second unload valve 69 when the pilot pressure is not led to the pilot chamber 69*a*. A second pilot passage 57 is connected to the pilot chamber 69*a*, and each of the control valves 21 to 24 is connected to the second pilot passage 57. In a state where at least one of the control valves 21 to 24 is operated and at the operation position, the working oil discharged from the main pump 31 through the control valves 21 to 24 at the operation position is led to the second pilot passage 57.

The first pilot passage 56 and the second pilot passage 57 are switched between merging and block through a merging valve 58. The merging valve 58 is switched to a merging position 58A or a block position 58B by a balance between the pilot pressure led to the pilot chambers 58*a* and 58*b* and a biasing force of a spring 55.

Here, a second detection passage 77 configured to detect the operation of the first travel control valve 11 and the second travel control valve 21 is connected to the pilot pump 32. The second detection passage 77 is connected to the tank passage 63 through the second travel control valve 21 and the first travel control valve 11. A second detection pressure lead-out passage 78 branching from the upstream of the second travel control valve 21 positioned at the uppermost stream is connected to the second detection passage 77. The pilot chamber 58*a* of the merging valve 58 is connected to the first detection pressure lead-out passage 62, and the pilot chamber 58*b* is connected to the second detection pressure lead-out passage 78.

As described above, when all of the first work control valves 12 to 14 and the second work control valves 22 to 24 are not operated and are at the neutral position, since the first detection passage 60 communicates with the tank passage 63, the pilot pressure is not led to the pilot chamber 58*a* of the merging valve 58. On the other hand, in a state where at least one of the first work control valves 12 to 14 and the second work control valves 22 to 24 is operated, since the communication between the first detection passage 60 and the tank passage 63 is blocked, the pilot pressure is led to the pilot chamber 58*a* of the merging valve 58 through the first detection pressure lead-out passage 62.

Moreover, when both of the first travel control valve 11 and the second travel control valve 21 are not operated and are at the neutral position, since the second detection passage 77 communicates with the tank passage 63, the pilot pressure is not led to the pilot chamber 58*b* of the merging valve 58. On the other hand, in the state where at least either one of the first travel control valve 11 and the second travel control valve 21 is operated, since the communication between the second detection passage 77 and the tank passage 63 is blocked, the pilot pressure is led to the pilot chamber 58*b* of the merging valve 58 through the second detection pressure lead-out passage 78.

When the pilot pressure is led to both the pilot chamber 58*a* and the pilot chamber 58*b* of the merging valve 58, the merging valve 58 is switched to the merging position 58A by the biasing force of the spring 55.

Subsequently, the operation of the fluid pressure control device 100 will be described.

In the state where all of the control valves 11 to 14 and 21 to 24 are not operated and are at the neutral position, the first switching valve 51 and the second switching valve 52 are brought to the open positions 51A and 52A by the biasing force of the springs 53 and 54, respectively. In this state, since the pilot chamber 67*a* communicates with the tank passage 63 through the first pilot passage 56, the first unload valve 67 is brought to the unload position 67B by the pressure of the upstream of the first unload valve 67. Similarly, the second unload valve 69 is also brought to the unload position 69B. Thus, a part of the working oil supplied from the first pump port 31*a* to the first main passage 41 and the working oil supplied from the second pump port 31*b* to the second main passage 42 is discharged to the tank passage 63 through the first unload valve 67 and the second unload valve 69, respectively.

In the state where at least one of the first work control valves 12 to 14 and the second work control valves 22 to 24 is operated and at the operation position, and the first travel control valve 11 and the second travel control valve 21 are operated and at the operation position, the pilot pressure is led to the pilot chamber 51*a* of the first switching valve 51 and the pilot chamber 52*a* of the second switching valve 52 through the first detection pressure lead-out passage 62, and the pilot pressure for operating the first travel control valve 11 and the second travel control valve 21 is led to the pilot chamber 51*b* of the first switching valve 51 and to the pilot chamber 52*b* of the second switching valve 52, respectively. Here, the pilot pressure led through the first detection pressure lead-out passage 62 is larger than the pilot pressure for operating the first travel control valve 11 and the second travel control valve 21. Therefore, the first switching valve 51 and the second switching valve 52 are brought to the open positions 51A and 52A. In this state, the working oil supplied from the first pump port 31*a* to the first main passage 41 and the working oil supplied from the second pump port 31*b* to the second main passage 42 merge through the merging passage 45. Thus, the working oil discharged from the first pump port 31*a* and the working oil discharged from the second pump port 31*b* merge and can be supplied to each of the hydraulic actuators 1 to 8.

Moreover, in this state, the pilot pressure is led to both the pilot chamber 58*a* and the pilot chamber 58*b*, and the merging valve 58 is switched to the merging position 58A by the biasing force of the spring 55. Thus, the first unload valve 67 is brought to the block position 67A by the pilot pressure led to the first pilot passage 56 through the operated control valve in each of the control valves 11 to 14 and 21 to 24. Similarly, the second unload valve 69 is also brought to the block position 69A.

As described above, since the pilot pressure led through the first detection pressure lead-out passage 62 is larger than the pilot pressure for operating the first travel control valve 11 and the second travel control valve 21, in the state where at least one of the first work control valves 12 to 14 and the second work control valves 22 to 24 is operated and at the operation position, the first switching valve 51 and the second switching valve 52 are brought to the open positions 51A and 52A regardless of the operations of the first travel control valve 11 and the second travel control valve 21.

In a state where the first work control valves 12 to 14 and the second work control valves 22 to 24 are not operated and are at the neutral position and the first travel control valve 11 is operated and at the operation position, since the pilot pressure is not led to the pilot chamber 51*a* but the pilot pressure for operating the first travel control valve 11 is led to the pilot chamber 51*b*, the first switching valve 51 is brought to the priority position 51B against the biasing force of the spring 53. Similarly, in a state where the first work control valves 12 to 14 and the second work control valves 22 to 24 are not operated and are at the neutral position and the second travel control valve 21 is operated and at the operation position, since the pilot pressure is not led to the pilot chamber 52*a* but the pilot pressure for operating the second travel control valve 21 is led to the pilot chamber 52*b*, the second switching valve 52 is brought to the priority position 52B against the biasing force of the spring 54. In this state, the working oil supplied from the first pump port 31*a* to the first main passage 41 is supplied only to the first travel control valve 11, and the working oil supplied from the second pump port 31*b* to the second main passage 42 is supplied only to the second travel control valve 21. In this way, in a state where only right and left travel devices are driven, since the working oil discharged from the first pump port 31*a* and the working oil discharged from the second pump port 31*b* are supplied to the left travel motor 1 and the right travel motor 5 independently, respectively, traveling performances of turning or going straight can be improved.

Moreover, in this state, since the pilot pressure is led to the pilot chamber 58*b*, the merging valve 58 is brought to the block position 58B. Therefore, when the first travel control valve 11 is operated, the first unload valve 67 is brought to the block position 67A by the pilot pressure led to the pilot chamber 67*a* through the first travel control valve 11. On the other hand, when the second travel control valve 21 is operated, the second unload valve 69 is brought to the block position 69A by the pilot pressure led to the pilot chamber 69*a* through the second travel control valve 21. In this way, the first unload valve 67 and the second unload valve 69 are independently controlled in accordance with the operation of the first travel control valve 11 and the second travel control valve 21, respectively.

In the fluid pressure control device 100, the merging and independence of the working oil discharged from the first pump port 31*a* and the working oil discharged from the second pump port 31*b* are performed by two valves, that is, the first switching valve 51 and the second switching valve 52. Switching of the first switching valve 51 and the second switching valve 52 to the priority positions 51B and 52B is performed separately on a condition of the operation of the first travel control valve 11 and the second travel control valve 21, respectively. Therefore, when the hydraulic excavator is to be turned to the right while the front work devices such as the boom, the arm, the bucket and the like are not driven, for example, since only the left-side travel device is driven, and the right-side travel device is not driven, the first switching valve 51 is at the priority position 51B, while the second switching valve 52 is at the open position 52A. In this state, the working oil discharged from the first pump port 31*a* is supplied independently to the left travel motor 1 through the first travel control valve 11 so that driving of the left travel motor 1 is made stable, while the working oil discharged from the second pump port 31*b* is supplied to the second travel control valve 21 and is supplied to the first work control valves 12 to 14 and the second work control valves 22 to 24 through the second switching valve 52 and the merging passage 45. In this way, the working oil discharged from the second pump port 31*b* is brought into a state where it can be supplied to each of the hydraulic actuators such as the boom cylinder 2, the bucket cylinder 3, the arm cylinder 6 and the like and thus, when the front work devices such as the boom, the arm, the bucket and the like are to be driven, they can be driven with good responsiveness.

If one of the right and left travel devices is to be driven while the front work devices such as the boom, the arm, the bucket and the like are not driven, for example, when the first switching valve 51 and the second switching valve 52 are both switched to the priority positions 51B and 52B, the working oil discharged from the first pump port 31*a* and the second pump port 31*b* is not brought into the state where it can be supplied to each of the hydraulic actuators such as the boom cylinder 2, the bucket cylinder 3, the arm cylinder 6 and the like. Thus, when the front work devices such as the boom, the arm, the bucket and the like are to be driven from this state, driving of the front work device is delayed for a period of time required for switching for the first switching valve 51 and the second switching valve 52 from the priority positions 51B and 52B to the open positions 51A and 52A.

According to the first embodiment described above, the following actions and effects are exhibited.

The merging and independence of the working oil discharged from the first pump port 31*a* and the working oil discharged from the second pump port 31*b* are performed by the first switching valve 51 and the second switching valve 52, and the switching to the priority positions 51B and 52B of the first switching valve 51 and the second switching valve 52 is performed on the condition of the operation of the first travel control valve 11 and the second travel control valve 21 separately, respectively. Therefore, in the state where only either one of the first travel control valve 11 and the second travel control valve 21 is operated, the switching valve corresponding to the operated travel control valve is brought to the priority position, while the switching valve corresponding to the travel control valve which is not operated is brought to the open position. Thus, the working oil from the pump port supplied to the travel control valve which is not operated is supplied to the first work control valves 12 to 14 and the second work control valves 22 to 24 through the switching valve and the merging passage 45. Therefore, when the first work control valves 12 to 14 and the second work control valves 22 to 24 are operated, the front work devices such as the boom, the arm, the bucket and the like can be driven with good responsiveness.

Subsequently, a variation of the aforementioned first embodiment will be described.

Figure 2:
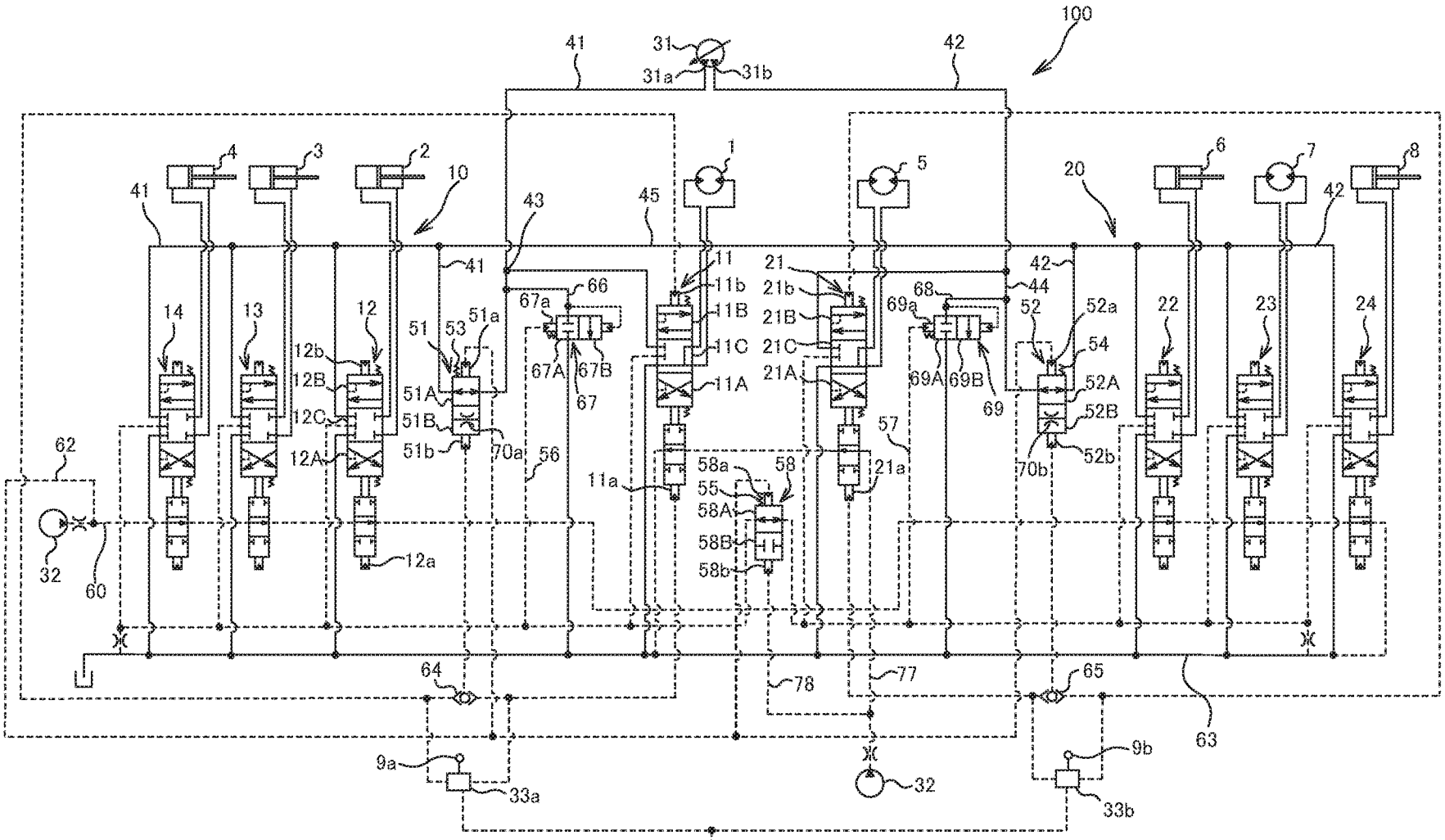
FIG. 2 is a circuit diagram of a fluid pressure control device according to a variation of the first embodiment of the present invention.

(1) In the aforementioned first embodiment, the first switching valve 51 and the second switching valve 52 block the flow of the working oil in the first main passage 41 and the second main passage 42 at the priority positions 51B and 52B. Instead of this, as illustrated in FIG. 2, it may be so configured that the first switching valve 51 and the second switching valve 52 do not fully block the flow of the working oil in the first main passage 41 and the second main passage 42 but apply resistance to the flow of the working oil at the priority positions 51B and 52B. More specifically, the first switching valve 51 and the second switching valve 52 have throttles 70*a* and 70*b* configured to throttle the flow of the working oil at the priority positions 51B and 52B. In this variation, too, the working oil supplied from the first pump port 31*a* to the first main passage 41 at the priority position 51B is supplied to the first travel control valve 11 with priority. Similarly, at the priority position 52B, the working oil supplied from the second pump port 31*b* to the second main passage 42 is supplied to the second travel control valve 21 with priority.

Moreover, when both the first switching valve 51 and the second switching valve 52 are at the priority positions 51B and 52B, basically, the working oil discharged from the first pump port 31*a* is supplied to the first travel control valve 11, and the working oil discharged from the second pump port 31*b* is supplied to the second travel control valve 21. However, if there is a pressure difference between the pressure of the working oil discharged from the first pump port 31*a* and the pressure of the working oil discharged from the second pump port 31*b* by a difference in loads on the left travel motor 1 and the right travel motor 5, the working oil discharged from the first pump port 31*a* and the working oil discharged from the second pump port 31*b* go back and forth through the throttles 70*a* and 70*b* and the merging passage 45. Therefore, since the pressure difference between the pressure of the working oil discharged from the first pump port 31*a* and the pressure of the working oil discharged from the second pump port 31*b* is absorbed, straightness of the travel device can be improved.

Figure 3:
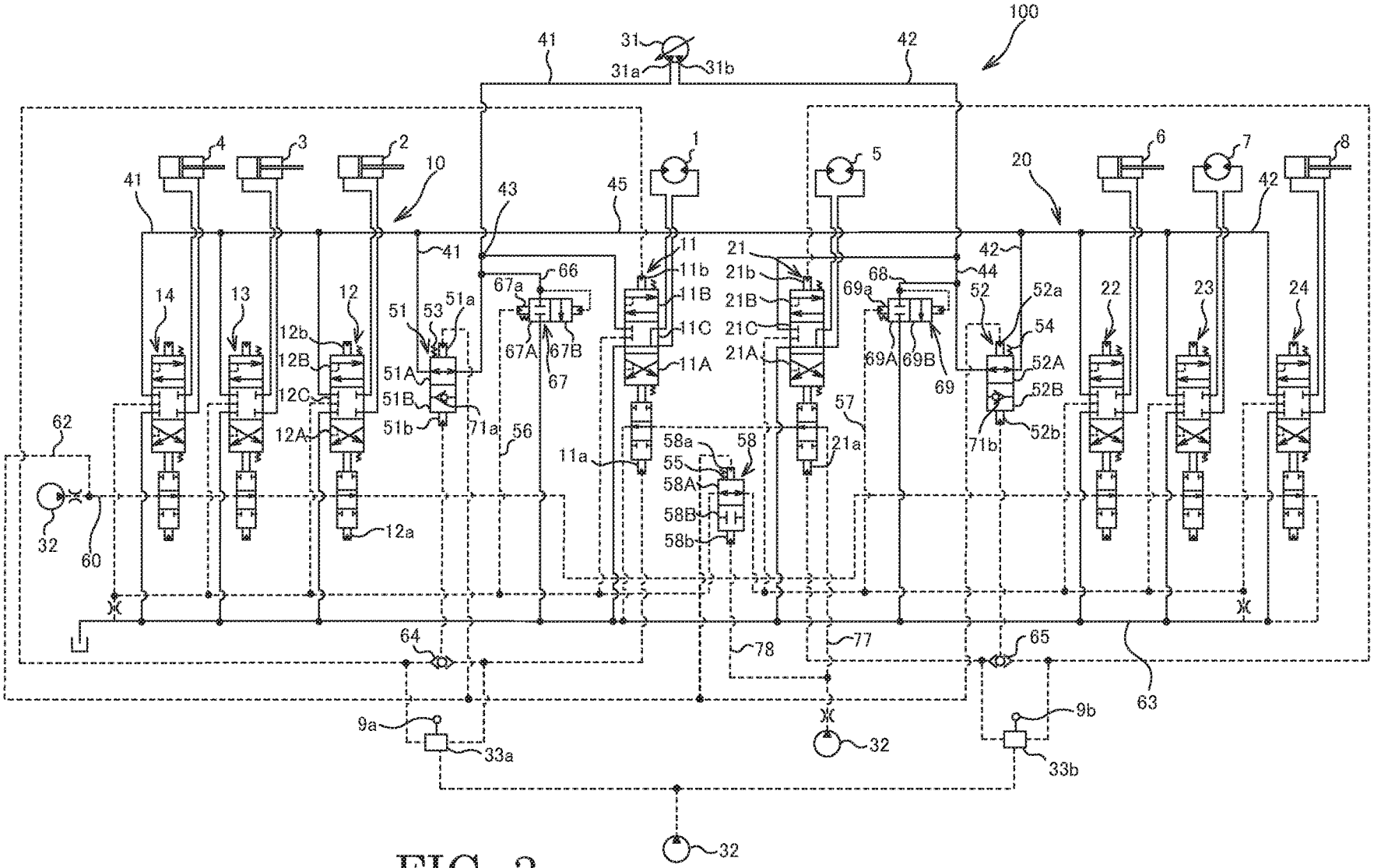
FIG. 3 is a circuit diagram of a fluid pressure control device according to a variation of the first embodiment of the present invention.

(2) As illustrated in FIG. 3, the first switching valve 51 has a check valve 71*a* configured to block the flow of the working oil from the first travel control valve 11 side to the first work control valves 12 to 14 side but to allow the flow in the opposite direction at the priority position 51B. Similarly, the second switching valve 52 has a check valve 71*b* configured to block the flow of the working oil from the second travel control valve 21 side to the second work control valves 22 to 24 side but to allow the flow in the opposite direction at the priority position 52B.

In this variation, since the flow of the working oil to the first work control valves 12 to 14 side is blocked by the check valve 71*a* at the priority position 51B, the working oil supplied from the first pump port 31*a* to the first main passage 41 is not supplied to the first work control valves 12 to 14 but is supplied to the first travel control valve 11 with priority. Similarly, since the flow of the working oil to the second work control valves 22 to 24 side is blocked by the check valve 71*b* at the priority position 52B, the working oil supplied from the second pump port 31*b* to the second main passage 42 is not supplied to the second work control valves 22 to 24 but is supplied to the second travel control valve 21 with priority. Therefore, in this variation, too, in the state where only the right and left travel devices are driven, the working oil discharged from the first pump port 31*a* and the working oil discharged from the second pump port 31*b* are independently supplied to the left travel motor 1 and the right travel motor 5, respectively.

Moreover, when the hydraulic excavator is to be turned to the right while the front work devices such as the boom, the arm, the bucket and the like are not driven, for example, since only the left-side travel device is driven, and the right-side travel device is not driven, the first switching valve 51 is at the priority position 51B, while the second switching valve 52 is at the open position 52A. In this state, the working oil discharged from the first pump port 31*a* is supplied to the left travel motor 1 through the first travel control valve 11. Moreover, the working oil discharged from the second pump port 31*b* is also supplied to the left travel motor 1 from the second switching valve 52, the merging passage 45, and the check valve 71*a* of the first switching valve 51 through the first travel control valve 11. Therefore, at turning of the hydraulic excavator, since the working oil can be supplied to the left travel motor 1 from both the first pump port 31*a* and the second pump port 31*b*, the left-side travel device can be driven stably.

(3) The throttles 70*a* and 70*b* illustrated in FIG. 2 and the check valves 71*a* and 71*b* illustrated in FIG. 3 may be provided in series. That is, it may be so configured that the first switching valve 51 has the throttle 70*a* and the check valve 71*a* provided in series with the throttle 70*a* at the priority position 51B, and the second switching valve 52 has the throttle 70*b* and the check valve 71*b* provided in series with the throttle 70*b* at the priority position 52B.

(4) In the aforementioned first embodiment, the main pump 31 is a split-flow type hydraulic pump having the two pump ports 31*a* and 31*b*. However, instead of this, it may be so configured that two main pumps are provided, and the working oil is supplied to the first main passage 41 and the second main passage 42 from pump ports of the two main pumps, respectively.

Second Embodiment

Figure 4:
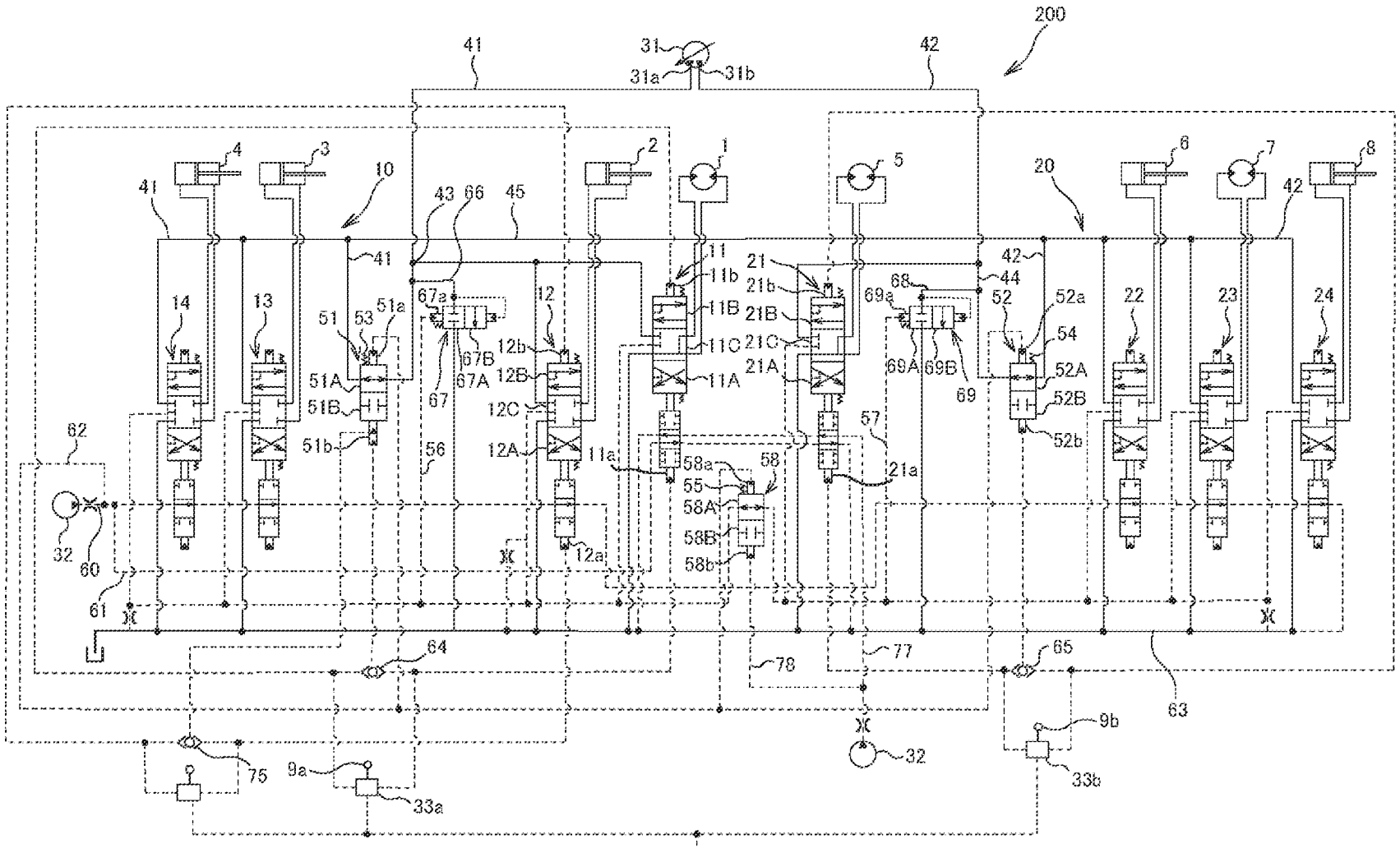
FIG. 4 is a circuit diagram of a fluid pressure control device according to a second embodiment of the present invention.

Subsequently, a fluid pressure control device 200 according to a second embodiment of the present invention will be described by referring to FIG. 4. Differences from the fluid pressure control device 100 according to the aforementioned first embodiment will be described below, and the same reference numerals are given to the same configurations as those in the fluid pressure control device 100 in the figures and the description will be omitted.

In the fluid pressure control device 100 according to the aforementioned first embodiment, only the first travel control valve 11 in the control valves 11 to 14 connected to the first main passage 41 in parallel is provided on the upstream of the first switching valve 51. On the other hand, in the fluid pressure control device 200, the first travel control valve 11 and the boom control valve 12 in the control valves 11 to 14 connected to the first main passage 41 in parallel are provided on the upstream of the first switching valve 51. That is, the boom control valve 12 is on the upstream of the first switching valve 51 and is connected to the first main passage 41 in parallel with the first travel control valve 11. Detailed description will be given below.

A branch detection passage 61 branching from the upstream of the blade control valve 14 located at the uppermost stream is connected to the first detection passage 60. The branch detection passage 61 is connected to the tank passage 63 through the first travel control valve 11 and the second travel control valve 21 in order. In a state where at least one of the first work control valves 12 to 14 and the second work control valves 22 to 24 is operated, and at least either one of the first travel control valve 11 and the second travel control valve 21 is operated, the pilot pressure is led to the pilot chamber 51*a* of the first switching valve 51 and the pilot chamber 52*a* of the second switching valve 52 through the first detection pressure lead-out passage 62.

The pilot chamber 51*b* of the first switching valve 51 is connected to the pilot chambers 11*a* and 11*b* of the first travel control valve 11 through the high-pressure selection valve 64 and is connected to the pilot chambers 12*a* and 12*b* of the boom control valve 12 through a high-pressure selection valve 75. Therefore, to the pilot chamber 51*b* of the first switching valve 51, a high-pressure pilot pressure in the pilot chamber 11*a* and the pilot chamber 11*b* of the first travel control valve 11 is led, and the high-pressure pilot pressure in the pilot chambers 12*a* and 12*b* of the boom control valve 12 is led. In this way, to the pilot chamber 51*b* of the first switching valve 51, the pilot pressure for operation of the first travel control valve 11 is led when the first travel control valve 11 is operated, and the pilot pressure for operation of the boom control valve 12 is led when the boom control valve 12 is operated.

Subsequently, an operation of the fluid pressure control device 200 will be described.

In a state where at least one of the first work control valves 12 to 14 and the second work control valves 22 to 24 is operated and at the operation position, and at least either one of the first travel control valve 11 and the second travel control valve 21 is operated and at the operation position, the pilot pressure is led to the pilot chamber 51*a* of the first switching valve 51 and the pilot chamber 52*a* of the second switching valve 52 through the first detection pressure lead-out passage 62, and the pilot pressure for operation of the first travel control valve 11 and the second travel control valve 21 is led to the pilot chamber 51*b* of the first switching valve 51 and the pilot chamber 52*b* of the second switching valve 52, respectively. Here, the pilot pressure led through the first detection pressure lead-out passage 62 is larger than the pilot pressure for operation of the first travel control valve 11 and the second travel control valve 21. Therefore, the first switching valve 51 and the second switching valve 52 are at the open positions 51A and 52A. In this state, the working oil supplied from the first pump port 31*a* to the first main passage 41 and the working oil supplied from the second pump port 31*b* to the second main passage 42 merge through the merging passage 45. Thus, the working oil discharged from the first pump port 31*a* and the working oil discharged from the second pump port 31*b* merge and can be supplied to each of the hydraulic actuators 1 to 8.

In a state where all of the first work control valves 12 to 14 and the second work control valves 22 to 24 are not operated and are at a neutral position, and the first travel control valve 11 is operated and at the operation position, since the pilot pressure is not led to the pilot chamber 51*a*, and the pilot pressure for operation of the first travel control valve 11 is led to the pilot chamber 51*b*, the first switching valve 51 is at the priority position 51B against the biasing force of the spring 53. Similarly, in a state where all of the first work control valves 12 to 14 and the second work control valves 22 to 24 are not operated and are at the neutral position, and the second travel control valve 21 is operated and at the operation position, since the pilot pressure is not led to the pilot chamber 52*a*, and the pilot pressure for operation of the second travel control valve 21 is led to the pilot chamber 52*b*, the second switching valve 52 is at the priority position 52B against the biasing force of the spring 54. In this way, in the state where only the right and left travel devices are driven, the working oil discharged from the first pump port 31*a* and the working oil discharged from the second pump port 31*b* are supplied independently to the left travel motor 1 and the right travel motor 5, respectively.

In a state where the first travel control valve 11 and the second travel control valve 21 are not operated and are at the neutral position, and the boom control valve 12 is operated and at the operation position, since the pilot pressure is not led to the pilot chamber 51*a*, and the pilot pressure for operation of the boom control valve 12 is led to the pilot chamber 51*b*, the first switching valve 51 is at the priority position 51B against the biasing force of the spring 53. On the other hand, since the pilot pressure is not led to the pilot chamber 52*a* or the pilot chamber 52*b*, the second switching valve 52 is at the open position 52A. In this state, the working oil supplied from the first pump port 31*a* to the first main passage 41 is supplied only to the boom cylinder 2, and the working oil supplied from the second pump port 31*b* to the second main passage 42 is supplied to each of the hydraulic actuators such as the bucket cylinder 3, the arm cylinder 6 and the like through the second switching valve 52 and the merging passage 45. Therefore, when the front work devices such as the boom, the arm, the bucket and the like are driven at the same time without driving the right and left travel devices, the working oil discharged from the first pump port 31*a* is led to the boom cylinder 2 with priority. Therefore, the boom which needs a driving force the most in the front work devices can be driven stably. In this way, the first switching valve 51 also has a function as a boom priority valve which leads the working oil to the boom cylinder 2 with priority.

In a state where the first travel control valve 11 and the boom control valve 12 are operated and at the operation position, the pilot pressure is led to the pilot chamber 51*a* of the first switching valve 51 through the first detection pressure lead-out passage 62, and the pilot pressure for operation of the first travel control valve 11 and the boom control valve 12 is led to the pilot chamber 51*b* of the first switching valve 51. Here, the pilot pressure led through the first detection pressure lead-out passage 62 is larger than the pilot pressure for operation of the first travel control valve 11 and the boom control valve 12. Therefore, the first switching valve 51 is at the open position 51A. On the other hand, in a state where the first travel control valve 11 and the boom control valve 12 are operated and at the operation position, the second switching valve 52 is also at the open position 52A by the pilot pressure led to the pilot chamber 52*a* through the first detection pressure lead-out passage 62. In this way, in the state where the first travel control valve 11 and the boom control valve 12 are operated, the working oil discharged from the first pump port 31*a* and the working oil discharged from the second pump port 31*b* merge. Therefore, even if the boom which needs the driving force in the front work devices the most is driven while the right and left travel devices are driven, the travel device can be driven stably.

According to the aforementioned second embodiment, the following actions and effects are exhibited.

In the fluid pressure control device 200, the boom control valve 12 is provided on the upstream of the first switching valve 51. In a state where the first travel control valve 11 and the second travel control valve 21 are not operated and are at the neutral position, and the boom control valve 12 is operated and at the operation position, the first switching valve 51 is at the priority position 51B, and the working oil discharged from the first pump port 31*a* is led to the boom cylinder 2 with priority. Therefore, when the front work devices such as the boom, the arm, the bucket and the like are driven at the same time without driving the right and left travel devices, the boom cylinder 2 can be operated stably.

Subsequently, a variation of the aforementioned second embodiment will be described.

(1) In the aforementioned second embodiment, the boom control valve 12 is provided on the upstream of the first switching valve 51, and the working oil discharged from the first pump port 31*a* is supplied to the boom control valve 12 with priority. That is, the boom control valve 12 is the priority control valve. However, the priority control valve is not limited to the boom control valve 12 but may be at least one of the first work control valves 12 to 14, and it is only necessary to select the control valve which supplies the working oil with priority.

(2) The first switching valve 51 and the second switching valve 52 do not fully block the flow of the working oil in the first main passage 41 and the second main passage 42 at the priority positions 51B and 52B but may be configured to apply resistance to the flow of the working oil similarly to FIG. 2.

(3) The first switching valve 51 may be configured to have a check valve which blocks the flow of the working oil from the first travel control valve 11 side to the first work control valves 12 to 14 side but allows the flow in the opposite direction at the priority position 51B similarly to FIG. 3. Moreover, similarly, the second switching valve 52 may be configured to have a check valve which blocks the flow of the working oil from the second travel control valve 21 side to the second work control valves 22 to 24 side but allows the flow in the opposite direction at the priority position 52B.

Figure 5:
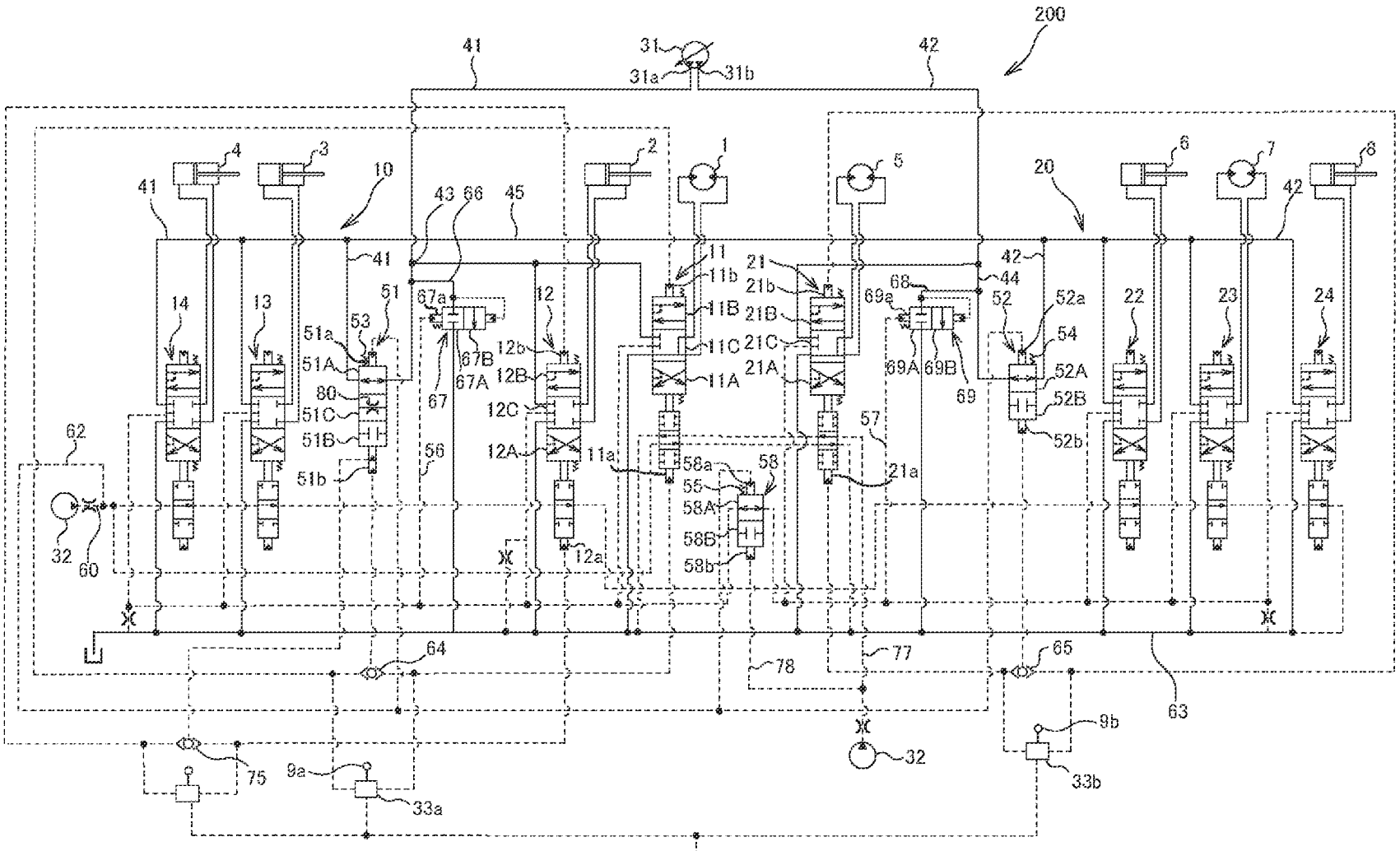
FIG. 5 is a circuit diagram of a fluid pressure control device according to a variation of the second embodiment of the present invention.

(4) In the aforementioned second embodiment, the first switching valve 51 has the two switching positions, that is, the open position 51A and the priority position 51B. Instead of this, as illustrated in FIG. 5, the first switching valve 51 may be configured to have a second priority position 51C in addition to the open position 51A and the priority position 51B. In the following, the priority position 51B is called a first priority position 51B.

The first priority position 51B blocks the flow of the working oil in the first main passage 41. A second priority position 51C applies resistance to the flow of the working oil in the first main passage 41. That is, the first switching valve 51 has a throttle 80 configured to throttle the flow of the working oil at the second priority position 51C.

In this variation, in the state where the first work control valves 12 to 14 and the second work control valves 22 to 24 are not operated and are at the neutral position, and the first travel control valve 11 is operated and at the operation position, since the pilot pressure is not led to the pilot chamber 51*a*, and the pilot pressure for operation of the first travel control valve 11 is led to the pilot chamber 51*b*, the first switching valve 51 is at the first priority position 51B against the biasing force of the spring 53.

In a state where the first travel control valve 11 and the second travel control valve 21 are not operated and are at the neutral position, and the boom control valve 12 is operated and at the operation position, since the pilot pressure is not led to the pilot chamber 51*a*, and the pilot pressure for operation of the boom control valve 12 is led to the pilot chamber 51*b*, the first switching valve 51 is at the second priority position 51C against the biasing force of the spring 53. Since the pilot pressure for operation of the boom control valve 12 is smaller than the pilot pressure for operation of the first travel control valve 11, the first switching valve 51 is at the second priority position 51C at an intermediate position. In this state, the first switching valve 51 leads the working oil discharged from the first pump port 31*a* to the boom control valve 12 located on the upstream of the throttle 80 with more priority than the other control valves.

Hereinafter, the configuration, actions and effects of the embodiments of the present invention will be described collectively.

The fluid pressure control device 100 includes the first main passage 41 to which the working fluid is supplied from the first pump port 31*a*, the second main passage 42 to which the working fluid from the second pump port 31*b* is supplied, a plurality of the first work control valves 12 to 14 for the work device connected to the first main passage 41 in parallel, a plurality of the second work control valves 22 to 24 for the work device connected to the second main passage 42 in parallel, the first travel control valve 11 for the travel device connected to the first main passage 41 in parallel at the upstream of the first work control valves 12 to 14, the second travel control valve 21 for the travel device connected to the second main passage 42 in parallel at the upstream of the second work control valves 22 to 24, the first switching valve 51 provided on the downstream of the connection portion 43 of the first travel control valve 11 in the first main passage 41 and having the open position 51A where the first main passage 41 is opened and the first priority position 51B where the working fluid from the first pump port 31*a* is led to the first travel control valve 11 with priority, the second switching valve 52 provided on the downstream of the connection portion 44 of the second travel control valve 21 in the second main passage 42 and having the open position 52A where the second main passage 42 is opened and the first priority position 52B where the working fluid from the second pump port 31*b* is led to the second travel control valve 21 with priority, and the merging passage 45 which connects the downstream of the first switching valve 51 in the first main passage 41 and the downstream of the second switching valve 52 in the second main passage 42, and in the state where the first work control valves 12 to 14 and the second work control valves 22 to 24 are not operated and the first travel control valve 11 is operated, the first switching valve 51 is at the first priority position 51B, and in the state where the first work control valves 12 to 14 and the second work control valves 22 to 24 are not operated and the second travel control valve 21 is operated, the second switching valve 52 is at the first priority position 52B.

In this configuration, merging and independence of the working fluid discharged from the first pump port 31*a* and the working fluid discharged from the second pump port 31*b* are performed by the first switching valve 51 and the second switching valve 52, and the switching of the first switching valve 51 and the second switching valve 52 to the first priority positions 51B and 52B is performed separately on the condition of the operation of the first travel control valve 11 and the second travel control valve 21, respectively. Therefore, in the state where only either one of the first travel control valve 11 and the second travel control valve 21 is operated, the switching valve corresponding to the operated travel control valve is at the first priority position, while the switching valve corresponding to the travel control valve which is not operated is at the open position. Thus, the working fluid from the pump port supplied to the travel control valve which is not operated is supplied to the first work control valves 12 to 14 and the second work control valves 22 to 24 through the switching valve and the merging passage 45. Therefore, when the first work control valves 12 to 14 and the second work control valves 22 to 24 are operated, the work device can be driven with good responsiveness. Thus, the fluid pressure control device with excellent workability can be provided.

Moreover, in the state where at least one of the plurality of first work control valves 12 to 14 and the plurality of second work control valves 22 to 24 is operated, the first switching valve 51 and the second switching valve 52 are at the open position 51A.

In this configuration, the working fluid discharged from the first pump port 31*a* and the working fluid discharged from the second pump port 31*b* can be merged and supplied to each of the control valves 11 to 14 and 21 to 24.

Moreover, at least one of the plurality of first work control valves 12 to 14 is the priority control valve provided on the upstream of the first switching valve 51 and provided in parallel with the first travel control valve 11, and in a state where the first travel control valve 11 and the second travel control valve 21 are not operated and the priority control valve is operated, the first switching valve 51 is at the first priority position 51B.

Moreover, at least one of the plurality of first work control valves 12 to 14 is the priority control valve on the upstream of the first switching valve 51 and provided in parallel with the first travel control valve 11, and the first switching valve 51 further has the second priority position 51C where the working fluid from the first pump port 31*a* is led to the priority control valve with more priority than the other first work control valves, and in the state where the first travel control valve 11 and the second travel control valve 21 are not operated and the priority control valve is operated, the first switching valve 51 is at the second priority position 51C.

In this configuration, the first switching valve 51 also has a function of leading the working fluid to the priority control valve with priority.

Moreover, in the state where the first travel control valve 11 and the priority control valve are operated, the first switching valve 51 is at the open position 51A.

In this configuration, even if the work device is driven while the travel device is driven, the travel device can be driven stably.

Moreover, the first switching valve 51 and the second switching valve 52 have the throttles 70*a* and 70*b* configured to apply resistance to the flow of the working fluid at the first priority positions 51B and 52B.

In this configuration, when the working fluid discharged from the first pump port 31*a* and the working fluid discharged from the second pump port 31*b* are supplied independently to the first travel control valve 11 and the second travel control valve 21, the working fluid discharged from the first pump port 31*a* and the working fluid discharged from the second pump port 31*b* go back and forth through the throttles 70*a* and 70*b* and the merging passage 45. Therefore, a pressure difference between the pressure of the working fluid discharged from the first pump port 31*a* and the pressure of the working fluid discharged from the second pump port 31*b* is absorbed and thus, the straightness of the travel device can be improved.

Moreover, the first switching valve 51 has the check valve 71*a* configured to block the flow of the working fluid from the first travel control valve 11 side to the first work control valves 12 to 14 side and to allow the flow in the opposite direction, and the second switching valve 52 has the check valve 71*b* configured to block the flow of the working fluid from the second travel control valve 21 side to the second work control valves 22 to 24 side and to allow the flow in the opposite direction at the first priority position 52B.

In this invention, in the state where the first switching valve 51 is at the first priority position 51B and the second switching valve 52 is at the open position 52A, the working fluid discharged from the first pump port 31*a* is supplied to the first travel control valve 11, and the working fluid discharged from the second pump port 31*b* is also supplied to the first travel control valve 11 through the second switching valve 52, the merging passage 45, and the check valve 71*a* of the first switching valve 51. Therefore, the driving of the travel device by the first travel control valve 11 can be made stable.

Moreover, the first switching valve 51 blocks the flow of the working fluid at the first priority position 51B, and has a throttle applying resistance to the flow of the working fluid at the second priority position 51C.

Embodiments of this invention were described above, but the above embodiments are merely examples of applications of this invention, and the technical scope of this invention is not limited to the specific constitutions of the above embodiments.

This application claims priority based on Japanese Patent Application No. 2018-87396 filed with the Japan Patent Office on Apr. 27, 2018, the entire contents of which are incorporated into this specification.

The invention claimed is:

1. A fluid pressure control device, comprising:

a first main passage to which a working fluid is supplied from a first pump port;

a second main passage to which the working fluid is supplied from a second pump port;

a plurality of first work control valves for work devices connected to the first main passage in parallel;

a plurality of second work control valves for work devices connected to the second main passage in parallel;

a first travel control valve for a travel device connected to the first main passage in parallel at an upstream of the first work control valves;

a second travel control valve for a travel device connected to the second main passage in parallel at an upstream of the second work control valves;

a first switching valve provided on a downstream of a connection portion with the first travel control valve in the first main passage and having an open position where the first main passage is opened and a first priority position where the working fluid from the first pump port is led to the first travel control valve with priority;

a second switching valve provided on a downstream of a connection portion with the second travel control valve in the second main passage and having an open position where the second main passage is opened and a first priority position where the working fluid from the second pump port is led to the second travel control valve with priority; and a merging passage connecting a downstream of the first switching valve in the first main passage and a downstream of the second switching valve in the second main passage, wherein in a state where the first work control valves and the second work control valves are not operated and the first travel control valve is operated, the first switching valve is at the first priority position; and in a state where the first work control valves and the second work control valves are not operated and the second travel control valves is operated, the second switching valve is at the first priority position.

2. The fluid pressure control device according to claim 1, wherein in a state where at least one of a plurality of the first work control valves and a plurality of the second work control valves is operated, the first switching valve and the second switching valve are at the open position.

3. The fluid pressure control device according to claim 1, wherein at least one of the plurality of the first work control valves is a priority control valve provided on an upstream of the first switching valve and in parallel with the first travel control valve; and in a state where the first travel control valve and the second travel control valve are not operated and the priority control valve is operated, the first switching valve is at the first priority position.

4. The fluid pressure control device according to claim 1, wherein at least one of the plurality of the first work control valves is a priority control valve provided on an upstream of the first switching valve and in parallel with the first travel control valve;

the first switching valve further has a second priority position where the working fluid from the first pump port is led to the priority control valve with more priority than the other first work control valves; and in a state where the first travel control valve and the second travel control valve are not operated and the priority control valve is operated, the first switching valve is at the second priority position.

5. The fluid pressure control device according to claim 3, wherein in a state where the first travel control valve and the priority control valve are operated, the first switching valve is at the open position.

6. The fluid pressure control device according to claim 4, wherein the first switching valve blocks a flow of the working fluid at the first priority position, and has a throttle applying resistance to the flow of the working fluid at the second priority position.

7. The fluid pressure control device according to claim 4, wherein in a state where the first travel control valve and the priority control valve are operated, the first switching valve is at the open position.

* * * * *